US009326079B2

(12) United States Patent
Tu et al.

(10) Patent No.: US 9,326,079 B2
(45) Date of Patent: Apr. 26, 2016

(54) DETECTION CIRCUIT

(71) Applicant: Acer Incorporated, New Taipei (TW)

(72) Inventors: Po-Jen Tu, New Taipei (TW); Tzu-Chun Chang, New Taipei (TW); Jia-Ren Chang, New Taipei (TW); Ming-Chun Yu, New Taipei (TW); Kuei-Ting Tai, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 109 days.

(21) Appl. No.: 14/185,067

(22) Filed: Feb. 20, 2014

(65) Prior Publication Data

US 2014/0294184 A1 Oct. 2, 2014

(30) Foreign Application Priority Data

Apr. 1, 2013 (TW) ..... 102111643 A

(51) Int. Cl.

| | |
|---|---|
| ***H04R 29/00*** | (2006.01) |
| ***H04R 1/10*** | (2006.01) |
| ***H04R 19/04*** | (2006.01) |
| ***H01R 24/58*** | (2011.01) |

(52) U.S. Cl.

CPC ..... *H04R 29/00* (2013.01); *H01R 24/58* (2013.01); *H04R 29/001* (2013.01); *H04R 29/004* (2013.01); *H04R 2201/107* (2013.01); *H04R 2420/05* (2013.01)

(58) Field of Classification Search

None

See application file for complete search history.

(56) References Cited

U.S. PATENT DOCUMENTS

| | | | | |
|---|---|---|---|---|
| 7,912,501 | B2 | 3/2011 | Johnson et al. | |
| 8,155,337 | B2 * | 4/2012 | Choi et al. | 381/74 |
| 2005/0090141 | A1 * | 4/2005 | Peng et al. | 439/488 |
| 2007/0049103 | A1 | 3/2007 | Kashi et al. | |
| 2008/0130911 | A1 | 6/2008 | Tsen | |
| 2008/0164994 | A1 | 7/2008 | Johnson et al. | |
| 2009/0227298 | A1 | 9/2009 | Fukunaga | |

(Continued)

FOREIGN PATENT DOCUMENTS

| | | | |
|---|---|---|---|
| CN | 201204638 | Y | 3/2009 |
| TW | 201225691 | A | 6/2012 |

(Continued)

OTHER PUBLICATIONS

European Search Report dated Feb. 26, 2015, issued in application No. 14161280.4

*Primary Examiner* — Andrew L Sniezek

(74) *Attorney, Agent, or Firm* — McClure, Qualey & Rodack, LLP

(57) ABSTRACT

A detection circuit is disclosed, in which the first and second pins are arranged to connect to at least one signal transduction area of the plug, such that a voltage division circuit generates first and second division voltages accordingly. A processing unit determines the signal transduction area(s) connected by the first and second pins by the first and second division voltages. When detecting that the first and second pins separately connect the microphone area and the ground area of the plug, the processing unit controls a microphone switch to connect the first pin to the microphone output node and the second pin to the ground. When detecting that the first pin and the second pin separately connect the ground area and the microphone area, the processing unit controls the microphone switch to connect the first pin to the ground and the second pin to the microphone output node.

9 Claims, 12 Drawing Sheets

(56) References Cited

U.S. PATENT DOCUMENTS

| | | | | |
|---|---|---|---|---|
| 2012/0200172 | A1 | 8/2012 | Johnson et al. | |
| 2013/0020882 | A1 | 1/2013 | Prentice | |
| 2013/0142350 | A1* | 6/2013 | Larsen et al. | 381/74 |
| 2013/0158919 | A1* | 6/2013 | Shah et al. | 702/64 |
| 2014/0100001 | A1* | 4/2014 | Im et al. | 455/570 |

FOREIGN PATENT DOCUMENTS

| | | | |
|---|---|---|---|
| WO | 2012031481 | A1 | 3/2012 |
| WO | 2012148682 | A1 | 11/2012 |

* cited by examiner

| | Fifth pin | Second pin |
|---|---|---|
| Default value | High voltage level | High voltage level |
| Microphone earphone of first type | High voltage level | Low voltage level |
| Microphone earphone of second type | Low voltage level | High voltage level |
| Normal earphone | Low voltage level | Low voltage level |

FIG. 6

DETECTION CIRCUIT

CROSS REFERENCE TO RELATED APPLICATIONS

This Application claims priority of Taiwan Patent Application No. 102111643, filed on Apr. 1, 2013, the entirety of which is incorporated by reference herein.

BACKGROUND OF THE INVENTION

1. Field of the Invention

The present invention relates to an electronic device, and in particular to an electronic device capable of automatically detecting the type of plug.

2. Description of the Related Art

Today's electronic devices, especially handheld electronic devices, are often equipped with an earphone socket to allow the user to use earphones to listen to music, record sound, or communicate with others, among other uses. Since a style of earphone that is combined with a microphone is becoming a trend, the electronic device needs to determine whether the earphone is a normal earphone, or one that is combined with a microphone, by the accommodated earphone plug. However, the plugs of the earphone combined with the microphone come in two types, and today's electronic devices typically can only determine the differences between the earphone combined with microphone and the normal earphone. When the user uses the plug, which is another type of earphone combined with a microphone, the electronic device loses the ability to determine its nature.

Therefore, a brand new method to address the issue is needed

BRIEF SUMMARY OF THE DISCLOSURE

A detailed description is given in the following embodiments with reference to the accompanying drawings.

An embodiment of a detection circuit is disclosed. A detection circuit configured to detect an earphone plug includes a first pin and a second pin, a voltage-detection circuit, a processing unit, a microphone switch, and a codec. The first pin and the second pin are configured to connect to at least one of signal transduction areas of the plug. The voltage-detection circuit is configured to generate a first division voltage and a second division voltage according to the signal transduction area(s) connected by the first pin and the second pin. The processing unit determines the signal transduction area(s) connected by the first pin and the second pin according to the first division voltage and the second division voltage, and generates a switch-control signal accordingly. The microphone switch is controlled by the switch-control signal, wherein the microphone switch connects the first pin and the second pin to a microphone output node and a ground, respectively, when the processing unit determines that the first pin and the second pin are respectively connected to a microphone area and a ground area of the plug. The microphone switch connects the first pin and the second pin to the ground and the microphone output node, respectively, when the processing unit determines that the first pin and the second pin are respectively connected to the ground area and the microphone area of the plug. The codec is coupled to the microphone output node.

BRIEF DESCRIPTION OF THE DRAWINGS

The present invention can be more fully understood by reading the subsequent detailed description and examples with references made to the accompanying drawings, wherein:

FIG. 6 is a table showing the judgments about the earphone plug;

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
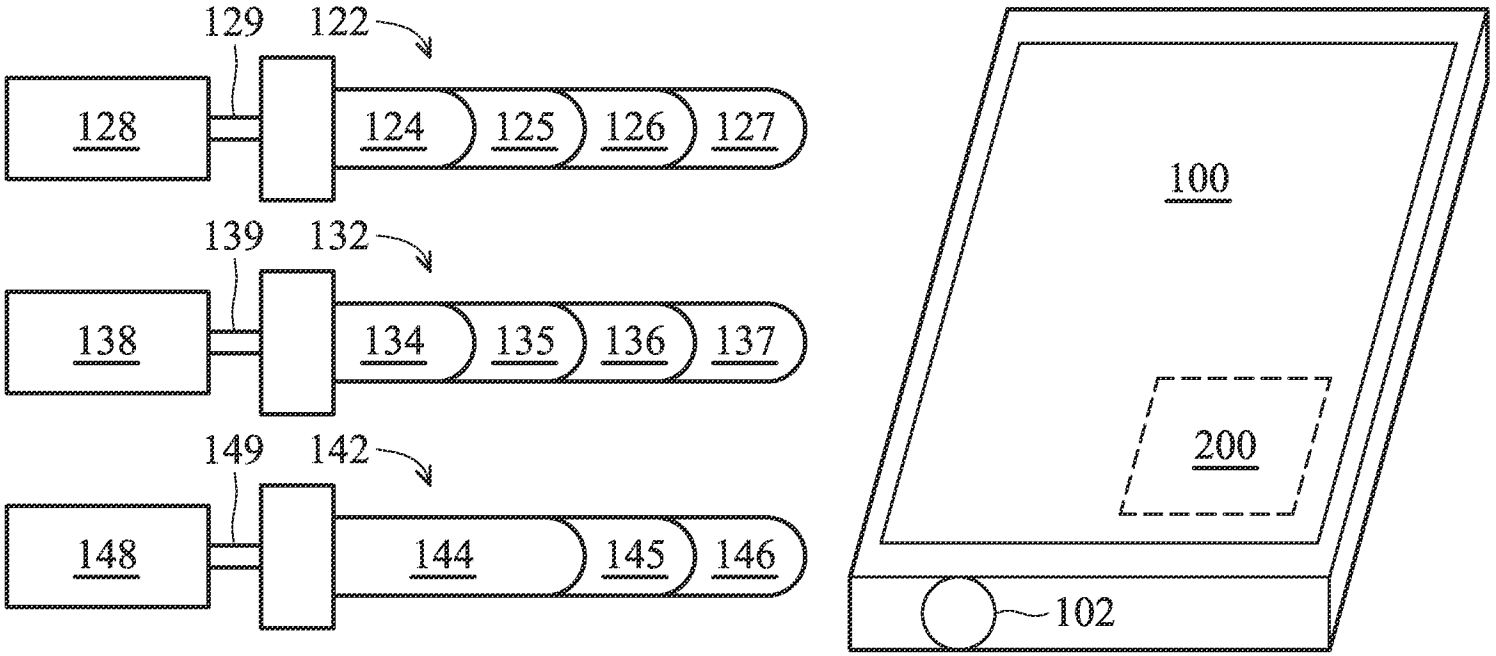
FIG. 1 is a schematic diagram showing the three types of plugs and an electronic device.

The electronic device as shown in FIG. 1 can accommodate three different types of plugs. In FIG. 1, the electronic device 100 comprises the socket 102 and the detection circuit 200. At any one time, the socket 102 can accommodate one of the following: the plug 122 of a microphone earphone 128 of the first type, the plug 132 of a microphone earphone 138 of the second type, or the plug 142 of a normal earphone 148. The microphone earphone 128 of the first type is connected to the plug 122 through a cable 129, and the microphone earphone 128 of the first type includes the earphone having the left and right stereo channels and the microphone. The plug 122 comprises four signal transduction areas arranged by a predetermined sequence along a single pin, and the predetermined sequence from the bottom of the plug are a microphone area 124, a ground area 125, a right audio-signal area 126 and an audio-signal area 127, wherein the left and right audio-signal areas are interchangeable with one another.

The microphone earphone 138 of the second type is connected to the plug 132 through a cable 139, and the microphone earphone 138 of the second type includes at least the earphone having the left and right stereo channels and the microphone. It should be noted that the major differences between the microphone earphone 128 of the first type and the microphone earphone 138 of the second type are the plug 122 and the plug 132. As shown in FIG. 1, the plug 132 comprises four signal transduction areas arranged by a predetermined sequence along a single pin, and the predetermined sequence from the bottom of the plug are a ground area 134, a microphone area 135, a right audio-signal area 136 and a left audio-signal area 137, wherein the left and right audio-signal areas are interchangeable with one another.

The normal earphone 148 is connected to the plug 142 through a cable 149, and the normal earphone 148 includes at least the earphone having the left and right stereo channels. The plug 142 includes three signal transduction areas arranged by a predetermined sequence along a single pin, and the predetermined sequence from the bottom of the plug are a ground area 144, a right audio-signal area 145 and a left audio-signal area 146, wherein the left and right audio-signal areas are interchangeable with one another. In other words, the normal earphone 148 does not include the microphone area.

Figure 2:
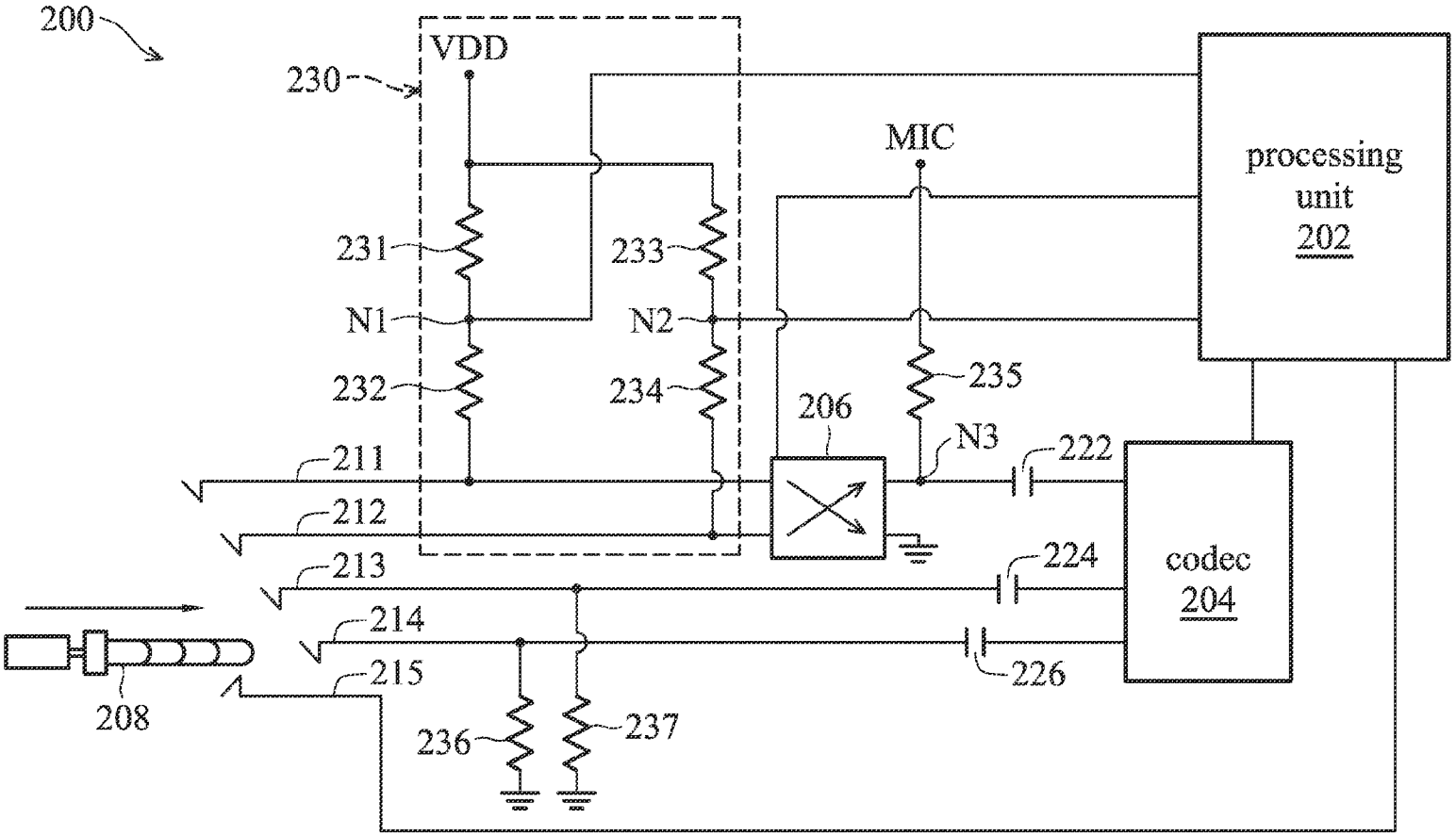
FIG. 2 is a schematic diagram showing an embodiment of a detection circuit of the invention.

FIG. 2 is an electronic schematic of a detection circuit in an embodiment of the present invention. The detection circuit 200 includes a processing unit 202, a codec 204, a microphone switch 206, a division voltage-detection circuit 230, first to fourth pins 211-214, resistors 231 to 237, and capacitors 222, 224 and 226. The first pin 211, the second pin 212, the third pin 213 and the fourth pin 214 are configured to electrically connect to the plug 208 accommodated in a socket (not shown). The four pins 211 to 214 are specifically laid in sequence to ensure that the first to the fourth pins 211-214 are electrically connected to their respective areas of the plug. For example, if the plug 208 is the plug 122 of the microphone earphone 128 of the first type shown in FIG. 1, the microphone area 124 is connected to the first pin 211, the ground area 125 is connected to the second pin 212, the right audio-signal area 126 is connected to the third pin 213, and the left audio-signal area 127 is connected to the fourth pin 214. If the plug 208 is the plug 132 of a microphone earphone 138 of the second type shown in FIG. 1, the ground area 132 is connected to the first pin 211, the microphone area 135 is connected to the second pin 212, the right audio-signal area 136 is connected to the third pin 213, and the left audio-signal area 137 is connected to the fourth pin 214. If the plug 208 is the plug 142 of the normal earphone 148 as shown in FIG. 1, the ground area 144 is connected to the first pin 211 and the second pin 212, the right audio-signal area 145 is connected to the third pin 213, and the left audio-signal area 146 is connected to the fourth pin 214.

The division voltage-detection circuit 230 includes resistors 231 to 234. The resistor 231 has a first terminal coupled to a voltage source VDD, and a second terminal coupled to a first division voltage node N1, wherein the voltage at the first division voltage node N1 is a first division voltage. The resistor 232 has a first terminal coupled to the first division voltage node N1, and a second terminal coupled to the first pin 211. The resistor 233 has a first terminal coupled to the voltage source VDD, and a second terminal coupled to a second division voltage node N2, wherein the voltage on the second division voltage node N2 is a second division voltage. The resistor 234 has a first terminal coupled to the second division voltage node N2, and a second terminal coupled to the second pin 212. The processing unit 202 determines that the plug 208 connected to the socket is the microphone earphone 128 of the first type, the microphone earphone 138 of the second type, or the normal earphone 148, according to the first voltage on the first division voltage node N1 and the second division voltage on the second division voltage node N2, and then outputs a switch-control signal according to the result of this determination.

The microphone switch 206 is coupled between the first and second pins 211 and 212, and the codec 204. The microphone switch 206 has a first input terminal coupled to the first pin 211, a second input terminal coupled to the second pin 212, a first output terminal coupled to a microphone output node N3, a second output node coupled to the ground, and a control terminal coupled to the switch-control signal output by the processing unit 202. The microphone switch 206 is configured to couple a corresponding pin connected to the microphone area of the plug 208 to the microphone output node N3, and couple a corresponding pin connected to the ground area of the plug 208 to the ground. For example, when the plug 208 connected to the socket belongs to the microphone earphone 128 of the first type, the microphone switch 206 will be controlled by the switch-control signal such that the first pin 211 is connected to the microphone output node N3, and the second pin 212 is connected to the ground. When the plug 208 connected to the socket belongs to the microphone earphone 138 of the second type, the microphone switch 206 will be controlled by the switch-control signal such that the second pin 212 is connected to the microphone output node N3, and the first pin 211 is connected to the ground. When the plug 208 connected to the socket belongs to a normal earphone 148, the microphone switch 206 will be controlled by the switch-control signal such that the first pin 211 and the second pin 212 are respectively connected to the ground and the microphone output node N3. In addition, during normal operation (i.e. the socket is not accommodating an earphone plug), the microphone switch 206 can be set as default open or default close. In the embodiment of this invention, when the microphone switch 206 is set as default open, the electrical connection between the microphone output node N3, and the first and second pins 211 and 212 will be disconnected and the first pin 211 and the second pin 212 will not be electrically connected to the ground.

Further, the microphone output node N3 is coupled to the microphone voltage source MIC through the resistor 235. The codec 204 has a first input terminal coupled to the microphone output node N3 through the capacitor 222, a second input terminal coupled to the third pin 213 through the capacitor 224, and a third input terminal coupled to the fourth pin 214 through the capacitor 226. The codec 204 is configured to convert the digital audio signal from the processing unit 202 to the analog audio signal sent to the plug 208 and/or convert the analog audio signal from the plug 208 to the digital audio signal sent to the processing unit 202, but is not limited thereto.

In addition, the detection circuit 200 further includes a fifth pin 215 connected to one of the first to fourth pins 211 to 214, when the plug 208 is accommodated in the socket. The processing unit 202 determines whether the plug 208 is accommodated in the socket or has been removed from the socket according to the transition of the voltage of the fifth pin 215.

Figure 3:
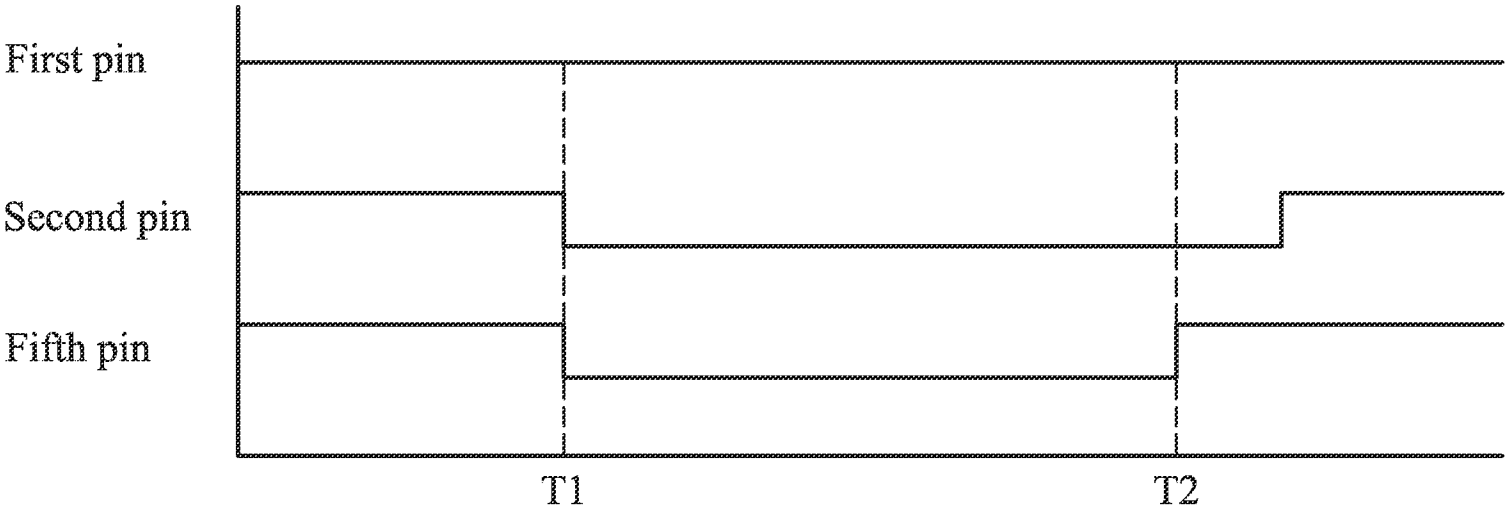
FIGS. 3-5 are timing diagrams corresponding to the different pins of the invention.

FIG. 3 is a voltage-variation timing diagram corresponding to the different pins of a plug of a microphone earphone of the first type which is accommodated in the socket. Since the microphone switch 206 is set as default open, it means that the first and second pins are not electrically connected to the microphone output node N3 or the ground. Therefore, when the first to the fourth pins are not connected to the microphone earphone 128, the first pin 211 and the second pin 212 are connected to the voltage source VDD by the division voltage-detection circuit 230, such that the first and second division voltages detected by the processing unit 202 are at high levels. Because the fifth pin 215 is not connected to the second pin 212, the fifth pin 215 is at a high-voltage level. Therefore, the first pin 211, the second pin 212, and the fifth pin 215 are at high-voltage levels before T1 as shown in FIG. 3.

When the plug of the microphone earphone 128 of the first type is accommodated (i.e. at T1) in the socket, and the sequence of the four signal transduction areas are the microphone area, the ground area, the right audio-signal area, and the left audio-signal area, the first pin 211 is at a high-voltage level and the second pin 212 is connected to the ground, wherein the connection to the ground belongs to the low-voltage level. At this time, the processing unit 202 detects that the first pin 211 is at a high-voltage level through the first division voltage of the first division voltage node N1 and detects that the second pin 212 is at a low-voltage level through the second division voltage of the second division voltage node N2. Further, because the fifth pin 215 is connected to the second pin 212 by the plug, the fifth pin 215 is also at a low-voltage level. In this embodiment, the processing unit 202 is set to determine that the plug has been removed from the socket, when the voltage of the fifth pin 215 is pulled to a high-voltage level. Namely, when the plug of the microphone earphone 128 of the first type is removed (i.e. at T2)

from the socket, the fifth pin 215 is pulled to a high-voltage level, and the detection circuit 200 determines that the plug was removed. In other words, the processing unit 202 determines whether the plug is accommodated in the socket or has been removed from the socket according to the toggling of the voltage on the fifth pin 215. The processing unit 202 rests the microphone switch 206 as default open, such that the second pin 212 and the first pin 211 will be at high-voltage levels again. As shown in FIG. 3, the fifth pin 215, the second pin 212, and the first pin 211 sequentially go back to a high-voltage level again.

Figure 4:
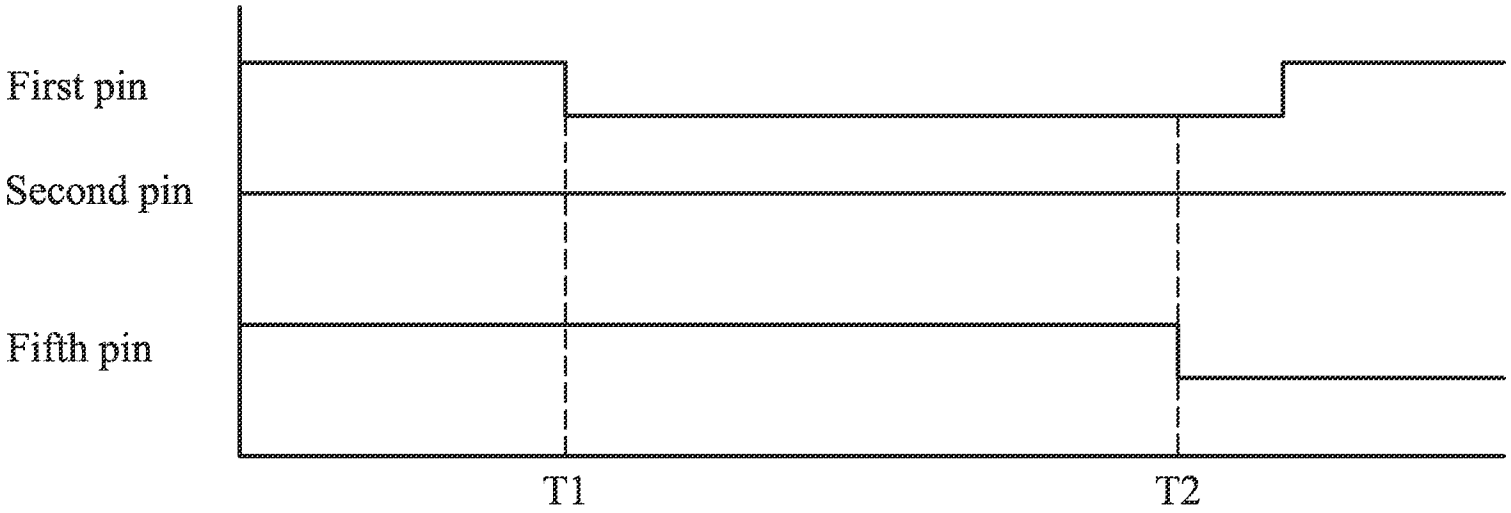

FIG. 4 is a voltage-variation timing diagram corresponding to the different pins of the plug of the microphone earphone 138 of the second type which is accommodated in the socket. Similarly, when the first pin 211 to fourth pin 214 are disconnected from the microphone earphone 138, the processing unit 202 detects that the first and second division voltages are high levels. When the plug of the microphone earphone 138 of the second type is accommodated in the socket (i.e. at T1), and the sequence of the four transduction areas of the plug are the ground area, the microphone area, the right audio-signal area, and the left audio-signal area, the first pin 211 is at a low-voltage level and the second pin 212 is at a high-voltage level. The processing unit 202 detects that the first pin 211 is at a low-voltage level and the second pin 212 is at a high-voltage level through the first division voltage of the first division voltage node N1 and the second division voltage on the second division voltage node N2 respectively. Thus, the processing unit 202 controls the microphone switch 206 to connect the first pin 211 to the ground area and to connect the second pin 212 to the microphone area. Further, the fifth pin 215 is connected to the second pin 212 by the plug, and thus the fifth pin is also at a high-voltage level. In this embodiment, the processing unit 202 is set to determine that the plug has been removed from the socket, when the voltage of the fifth pin 215 is pulled to a low-voltage level. Namely, when the plug of the microphone earphone 138 of the second type is removed (i.e. at T2), the fifth pin 215 is pulled to a low-voltage level, and the detection circuit 200 then determines that the plug has been removed. Next, the processing unit 202 resets the microphone switch 206 as default open, such that the first pin 211 and the second pin 212 go back to a high-voltage level again. As shown in FIG. 4, the fifth pin 215, the second pin 212, and the first pin 211 sequentially go back to a high-voltage level again.

Figure 5:
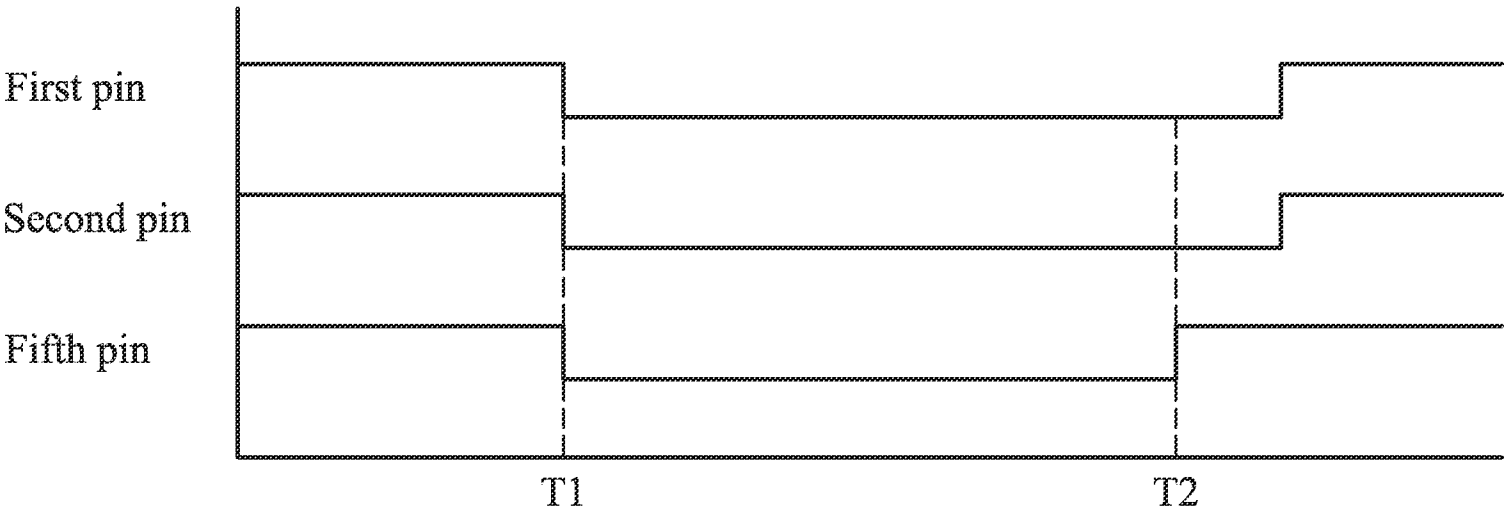

FIG. 5 is a voltage-variation timing diagram corresponding to the different pins of the plug of the normal earphone 148 which is accommodated in the socket. Similarly, when the first pin 211 to fourth pin 214 are disconnected from the microphone earphone 138, the processing unit 202 detects that the first and second division voltages are at high voltage levels. When the plug of the normal earphone 148 is accommodated in the socket (i.e. at T1), and the sequence of the three transduction areas of the plug are the ground area, the right audio-signal area, and the left audio-signal area, the first pin 211 and the second pin 212 are at high-voltage levels. The processing unit 202 detects that the first pin 211 and the second pin 212 are both at low-voltage levels through the first and second division voltages on the first division voltage nodes N1 and second division voltage nodes N2. Further, the fifth pin 215 is connected to the second pin 212, and thus the fifth pin 215 is also at a low-voltage level. In this embodiment, the processing unit 202 is set to determine that the plug has been removed from the socket, when the voltage of the fifth pin 215 is pulled to a high-voltage level. Namely, when the plug of the normal earphone 148 is removed (i.e. at T2), the voltage of the fifth pin 215 will be pulled to a high-voltage level, and the detection circuit 200 then determines that the plug has been removed. Then, the processing unit 202 rests the microphone switch 206 as default open, such that the first pin 211 and the second pin 212 go back to a high-voltage level again. As shown in FIG. 5, the fifth pin 215, the first pin 211 and the second pin 212 go back to high-voltage levels again.

Therefore, in the present embodiment, the determination concluded by the detection circuit 200 about the types of earphone plugs is summarized in the table in FIG. 6. Since the microphone switch 206 is set as default open, the first pin 211 and the second pin 212 are both set at high-voltage levels when the plug is not yet accommodated in the socket. When the plug of the microphone earphone 128 of the first type is accommodated in the socket, the first pin 211 is at a high-voltage level, and the second pin 212 is pulled to a low-voltage level. When the plug of the microphone earphone 138 of the second type is accommodated in the socket, the second pin 212 is at a high-voltage level, and the first pin 211 is pulled to a low-voltage level. When the plug of the normal earphone 148 is accommodated in the socket, the first pin 211 and the second pin 212 are both at low-voltage levels. Above all, if only the first pin 211 or the second pin 212 is at a low-voltage level, it can be determined that the plug of the earphone is accommodated in the socket and the earphone is a microphone earphone. If both the first pin 211 and the second pin 212 are at low-voltage levels, it can be determined that the plug of the earphone is accommodated in the socket and the earphone is the normal earphone.

Figure 7:
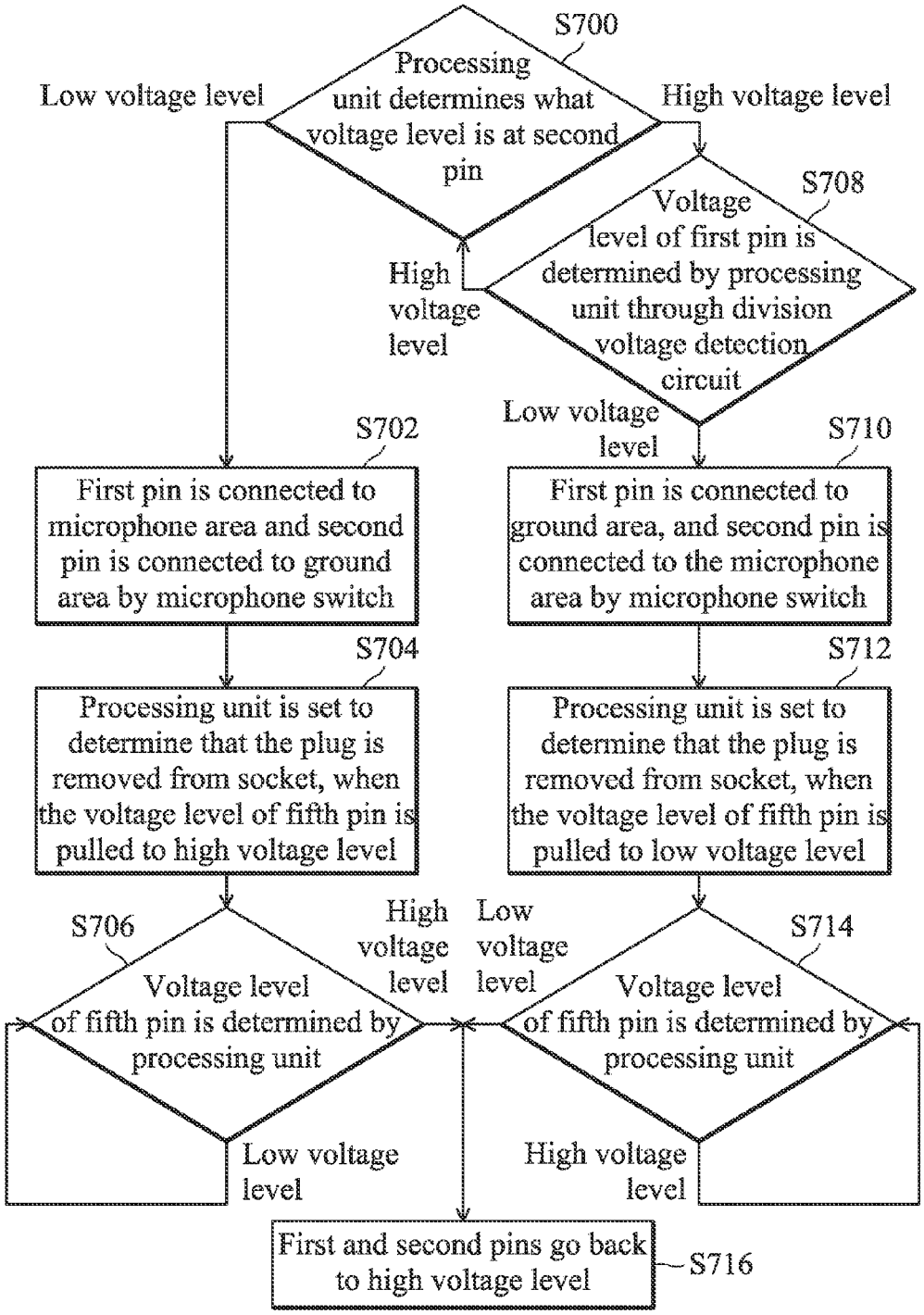
FIG. 7 is a schematic diagram showing an embodiment of another detection circuit of the invention.

FIG. 7 is an operation flowchart of the detection circuit of the present invention. In the embodiment, the fifth pin 215 is configured to be electrically connected to the second pin 212, when the plug is accommodated in the socket and the microphone switch is set as default open. In step S700, the processing unit 202 determines the voltage level at the second pin 212 through the division voltage-detection circuit 230. If the second pin 212 is at a low-voltage level, step S702 is performed, and if the second pin 212 is at a high-voltage level, step S708 is performed. When the second pin 212 is at a low-voltage level, because the fifth pin 215 is electrically connected to the second pin 212, the fifth pin 215 is also at a low-voltage level, and the plug of the earphone accommodated in the socket is detected by the processing unit 202 through the fifth pin 215. In step S702, the switch-control signal sent from the processing unit 202 is received by the microphone switch 206 such that the first pin 211 is connected to the microphone area and the second pin 212 is connected to the ground area. In step S704, the processing unit 202 is set to determine that the plug has been removed from the socket when the voltage level of the fifth pin 215 is pulled to a high-voltage level. In step S706, the voltage level of the fifth pin 215 is determined by the processing unit 202. When the voltage level of the fifth pin 215 is at a low-voltage level, it goes back to step S706, and it means that the plug of the earphone has not been removed from the socket and the electronic device 100 is still using the earphone. When the voltage level of the fifth pin 215 is high, it means that the plug of the earphone has been removed from the socket, as detected by the processing unit 202, and then step S716 is performed. In step S716, the processing unit 202 controls the microphone switch 206 such that the first pin 211 and the second pin 212 go back to the high-voltage level again. Namely, the microphone switch 206 will be reset as default open.

In step S708, the voltage level of the fifth pin 211 is determined by the processing unit 202 through the division voltage-detection circuit 230. If the first pin 211 is at a high-voltage level, then it goes back to step S700, which means none of the plugs are accommodated in the socket, and the voltage goes back to the default voltage. If the first pin 211 is at a low-voltage level, it means that the earphone plug is accommodated in the socket, and step S710 is performed. In step S710, the microphone switch 206 receives the switch-control signal sent from the processing unit 202 such that the first pin 211 is connected to the ground area, and the second pin 212 is connected to the microphone area. Then, in step S712, the processing unit 202 is set to determine that the plug has been removed from the socket, when the voltage level of the fifth pin 215 is pulled to a low-voltage level. In step S714, the voltage level of the fifth pin 215 is determined by the processing unit 202. If the fifth pin 215 is at a high-voltage level, the method goes back to step S714, it means that the plug of the earphone has not been removed, and the electronic device 100 is still using the earphone. If the voltage level of the fifth pin 215 is at a low-voltage level, it means that the earphone is removed, and then step S716 is performed. In step S716, the microphone switch 206 receives the switch-control signal sent from the processing unit 202 such that the first and second pins go back to the high-voltage level.

Figure 8:
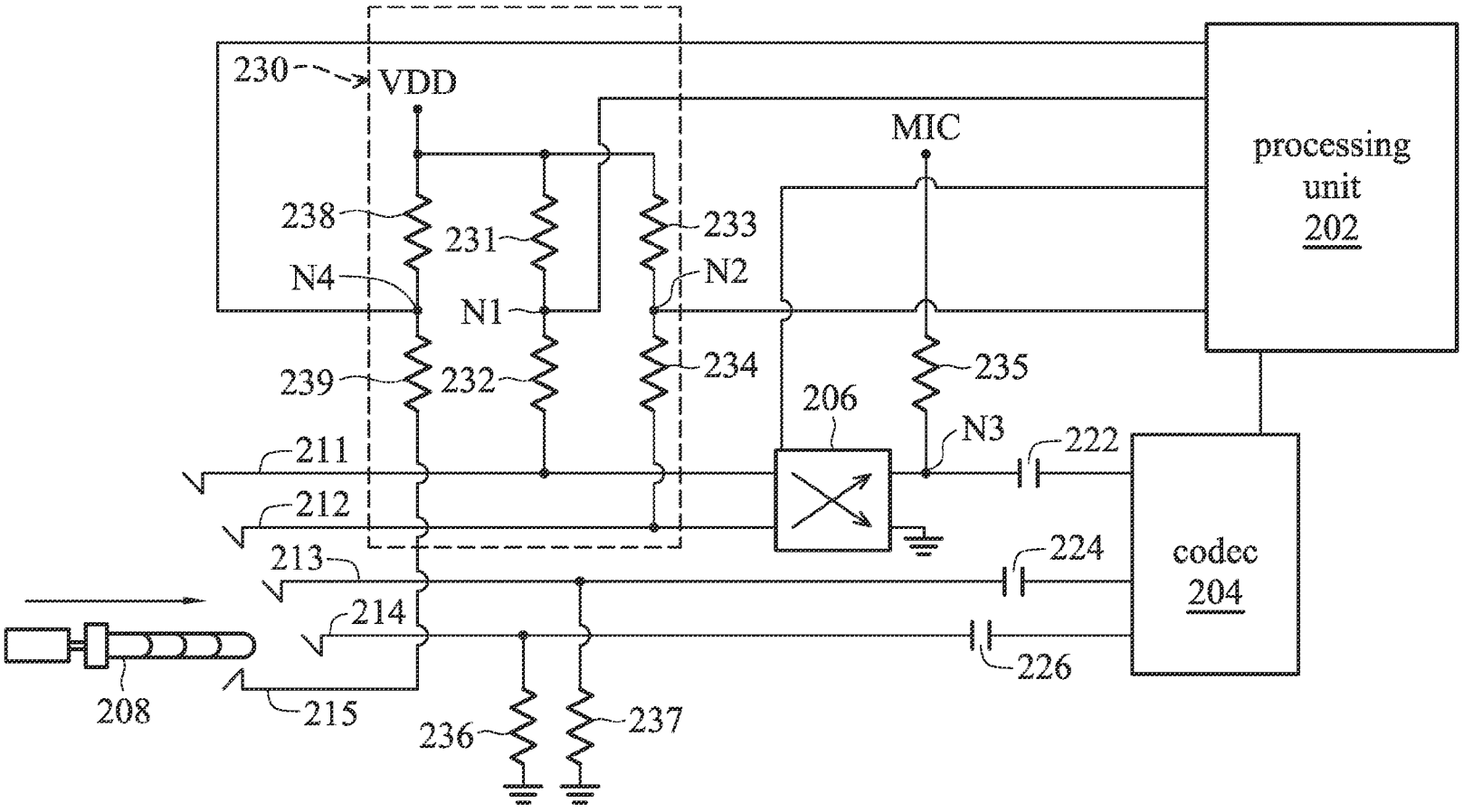
FIGS. 8-11 are timing diagrams corresponding to the different pins of the invention.

FIG. 8 is another embodiment of the detection circuit 200. The differences between the present embodiment and the embodiment of FIG. 2 are that the present embodiment not only includes the resistors 231-234, but also includes the resistors 238 and 239. The resistor 238 has a first terminal coupled to the voltage source VDD and a second terminal coupled to a third division voltage of a third division voltage node N4. The resistor 239 has a first terminal coupled to the third division voltage node N4, and a second terminal coupled to the fifth pin 215. Another difference is that the third division voltage node N4 is electrically coupled to the processing unit 202, and the fifth pin 215 is electrically coupled to the fourth pin 214 when a plug is accommodated in the socket. In addition, the function and the operation of the microphone switch 206, the codec 204, the processing unit 202, and the four pins are the same as in the previous embodiment.

Figure 9:
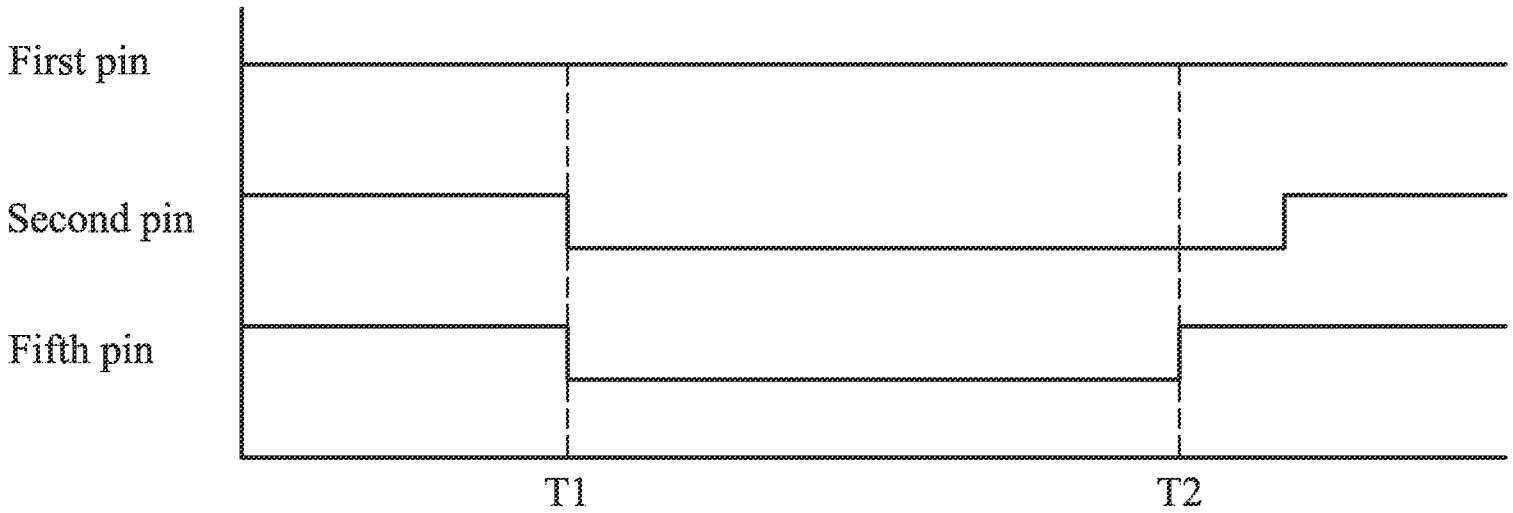

FIG. 9 is a voltage-variation timing diagram corresponding to the different pins of the plug of the microphone earphone of the first type accommodated as shown in FIG. 8. When the first to fourth pins 211 to 214 are not connected to the microphone earphone 128, the microphone 206 is set as default open, and the first pin 211 and the second pin 212 are connected to the voltage source VDD through the division voltage-detection circuit 230, such that the processing unit 202 detects that the first and second division voltages are at high voltage levels. Therefore, as shown in FIG. 9, the first pin 211, the second pin 212, and the fifth pin 215 are at high-voltage levels before time T1.

When the plug of the microphone earphone 128 of the first type is accommodated in the socket, and the sequence of the four signal transduction areas of the plug are, sequentially, the microphone area, the ground area, the right audio-signal area, and the left audio-signal area, then the first pin 211 is at a high-voltage level, and the second pin 212 is pulled to a low-voltage level. At this time, the processing unit 202 detects that the fifth pin 215 is at a low-voltage level through the third division voltage of the third division voltage node N4. Then, the processing unit 202 controls the microphone switch 206 to connect the first pin 211 to the microphone area, and to connect the second pin 212 to the ground area. When the plug of the microphone earphone 128 of the first type is removed (At time T2 of FIG. 9), the fifth pin is pulled to a high-voltage level, such that the processing unit 202 determines that the plug has been removed. Then, the processing unit 202 resets the microphone switch 206 as default open, the second pin 212 and the first pin 211 go back to the high-voltage level. As shown in FIG. 9, the fifth pin 215, the second pin 212, and the first pin 211 each go back sequentially to a high-voltage level.

Figure 10:
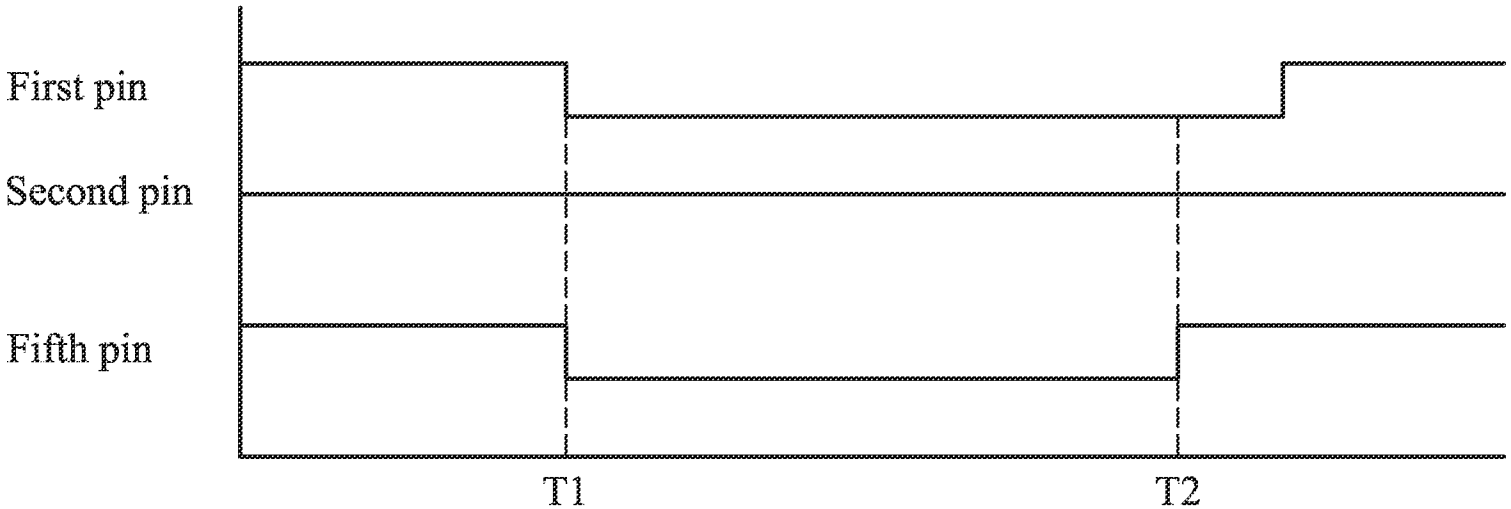

FIG. 10 is a voltage-variation timing diagram corresponding to the different pins of the plug of the microphone earphone 138 of the second type which is accommodated in the socket. As per the operations described in FIG. 9, the first pin 211, the second pin 212 and the fifth pin 215 are also at high-voltage levels before time T1. When the plug of the microphone earphone 138 of the first type is accommodated in the socket (at time T1), and the sequence of the four signal transduction areas of the plug are the ground area, the microphone area, the right audio-signal area, and the left audio-signal area, then the first pin 211 is at a low-voltage level and the second pin 212 is at a high-voltage level. Since the fifth pin 215 is coupled to the right/left audio-signal area of the plug 208, the processing unit 202 determines that the fifth pin 215 is at a low-voltage level through the third division voltage of the third division voltage node N4. Accordingly, the processing unit 202 controls the microphone switch 206 to connect the first pin 211 to the ground area, and to connect the second pin 212 to the microphone area. When the plug of the microphone earphone 138 of the second type is removed (At time T2 of FIG. 10), the fifth pin 215 is pulled to a high-voltage level, such that the processing unit 202 determines that the plug has been removed. Then, the processing unit 202 resets the microphone switch 206 as default open, and the second pin 212 and the first pin 211 go back to high-voltage levels again.

Figure 11:
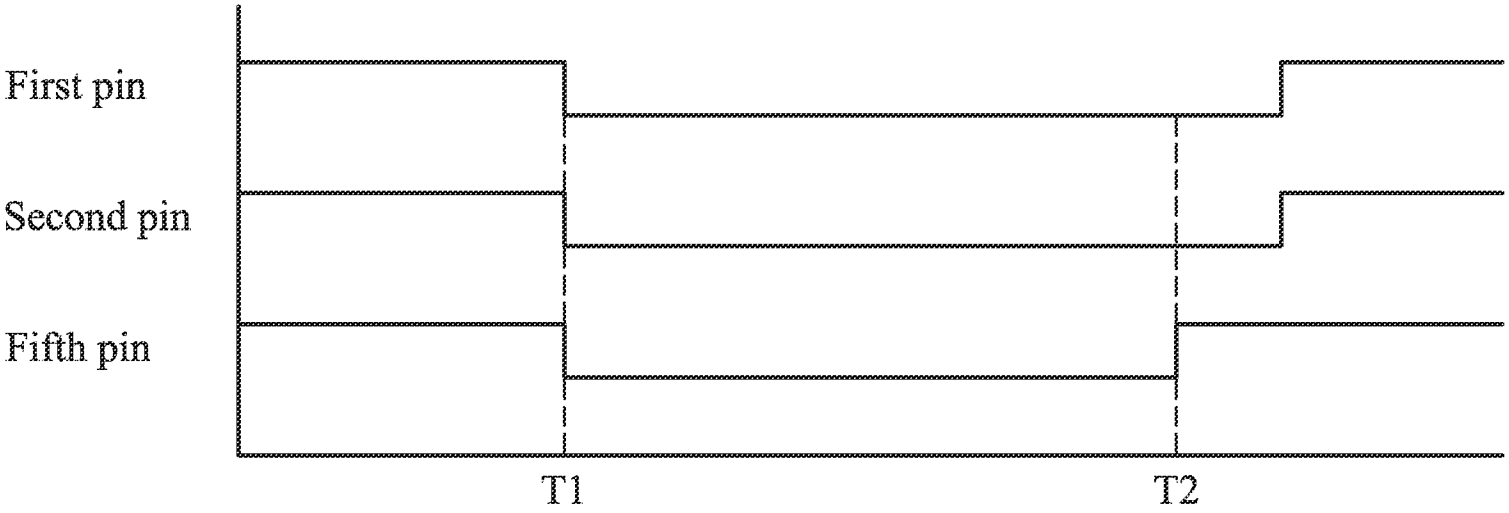

FIG. 11 is a voltage-variation timing diagram corresponding to the different pins of the plug of the normal earphone 148 which is accommodated in the socket. As the operations described in FIG. 9, the first pin 211, the second pin 212, and the fifth pin 215 are also at high voltage level before time T1. When the plug of the normal earphone 148 is accommodated in the socket (at time T1), the sequence of the three transduction areas of the plug are the ground area, the right audio-signal area, and the left audio-signal area, and thus the first pin 211 and the second pin 212 are at low-voltage levels. Since the fifth pin 215 is coupled to the right/left audio-signal area of the plug 208, the processing unit 202 detects that the fifth pin 215 is at a low-voltage level through the third division voltage of the third division voltage node N4. Accordingly, the processing unit 202 controls the microphone switch 206 to connect the first pin 211 to the ground area, and to connect the second pin 212 to the microphone area. When the plug of the normal earphone 148 is removed (At time T2), the fifth pin is pulled to a high-voltage level, such that the processing unit 202 determines that the plug has been removed. Then, the processing unit 202 resets the microphone switch 206 as default open, and the second pin 212 and the first pin 211 go back to the high-voltage level again. As show in FIG. 11, the fifth pin 215, the first pin 211, and the second pin 212 go back to the high-voltage level.

Figure 12:
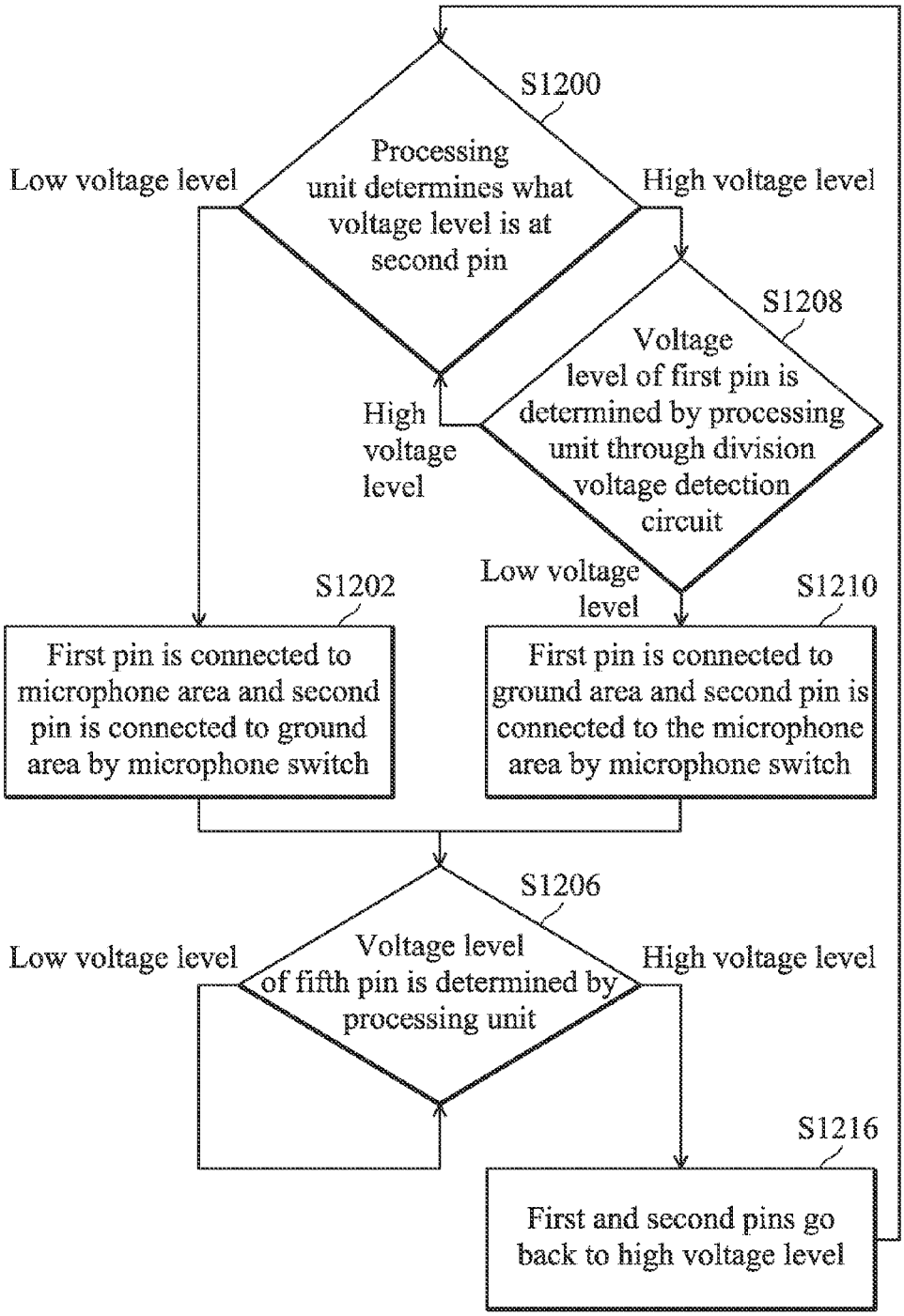
FIG. 12 is a flowchart showing an embodiment of another detection circuit of the invention.

FIG. 12 is an operation flow chart of another detection circuit of the present invention. In the present embodiment, the fifth pin 215 is electrically connected to the fourth pin 214 when the plug is accommodated in the socket, and the microphone switch 206 is set as default open. In step S1200, the voltage at the second pin 212 is determined by the processing unit 202 through the division voltage-detection circuit 230. If the first pin 211 is at a low-voltage level, then step S1202 is performed. If the first pin 211 is at a high-voltage level, then step S1208 is performed. In step S1202, the microphone switch 206 receives the switch-control signal sent from the processing unit 202, such that the first pin 211 is connected to the microphone area and the second pin 212 is connected to the ground area, and then step S1206 is performed. In step S1206, the voltage level of the fifth pin 215 is determined by the processing unit 202. If the fifth pin 215 is at a high-voltage level, then the method goes back to step S1206, meaning that the plug of the earphone has not been removed, and the electronic device 100 is still using the earphone. If the voltage level of the fifth pin 215 is at a low-voltage level, it means that the earphone has been removed, and then step S1216 is performed. In step S1216, the microphone switch 206 is controlled by the processing unit 202, such that the first pin 211 and the second pin 212 go back to the high-voltage level again. In step S1208, the processing unit 202 determines the voltage of the first pin 211 by the division voltage-detection circuit 230. If the first pin 211 is at a high-voltage level, then the method goes back to step S1200, meaning that no plug is accommodated in the socket and the voltage goes back to the default voltage. If the first pin 211 is at a low-voltage level, it means that the plug is accommodated and then step S1210 is performed. In step S1210, the microphone switch 206 receives the switch-control signal sent from the processing unit 202, such that the first pin 211 is connected to the ground area, and the second pin 212 is connected to the microphone area. Then, step S1206 is performed in the operation as described above, and thus the details thereof are omitted for brevity.

In the embodiments described above, the fifth pin 215 is electrically connected to the second pin 212 or the fourth pin 214, and the microphone switch 206 is set as default open, when the plug is accommodated in the socket. It should be noted that, when the fifth pin 215 is accommodated in the socket, the fifth pin 215 can be electrically connected to one of the first to fourth pins 211 to 214, and the microphone switch 206 can be set as default open or default close.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A detection circuit, configured to detect an earphone plug, comprising:

a first pin and a second pin, configured to connect to at least one of signal transduction areas of the plug;

a voltage-detection circuit, configured to generate a first division voltage and a second division voltage according to the signal transduction area(s) connected by the first pin and the second pin;

a processing unit, determining the signal transduction area(s) connected by the first pin and the second pin according to the first division voltage and the second division voltage and generating a switch-control signal accordingly;

a microphone switch, controlled by the switch-control signal, wherein the microphone switch connects the first pin and the second pin respectively to a microphone output node and a ground when the processing unit determines that the first pin and the second pin are respectively connected to a microphone area and a ground area of the plug, and the microphone switch connects the first pin and the second pin to the ground and the microphone output node, respectively, when the processing unit determines that the first pin and the second pin are respectively connected to the ground area and the microphone area of the plug; and a codec, coupled to the microphone output node.

2. The detection circuit as claimed in claim 1, wherein the codec is configured to convert a digital audio signal from the processing unit to an analog audio signal, and convert an analog audio signal from the plug to a digital audio signal.

3. The detection circuit as claimed in claim 1, wherein the detection circuit further comprises a third pin and a fourth pin, configured to connect a right audio-signal area and a left audio-signal area of the plug, and the codec.

4. The detection circuit as claimed in claim 3, wherein the division voltage-detection circuit comprises:

a first resistor, having a first terminal coupled to a voltage source, and a second terminal coupled to a first division voltage node;

a second resistor, having a first terminal coupled to the first division voltage node, and a second terminal coupled to the ground;

a third resistor, having a first terminal coupled to the voltage source, and a second terminal coupled to a second division voltage node; and a fourth resistor, having a first terminal coupled to the second division voltage node, and a second terminal coupled to the ground.

5. The detection circuit as claimed in claim 4, further comprising a fifth pin configured to connect one of the first to fourth pins when the plug is accommodated in a socket, wherein the processing unit determines whether the plug is accommodated in the socket or has been removed from the socket according to toggling of the voltage on the fifth pin.

6. The detection circuit as claimed in claim 5, wherein the division voltage-detection circuit comprises:

a first resistor, having a first terminal coupled to a voltage source, and a second terminal coupled to a first division voltage node;

a second resistor, having a first terminal coupled to the first division voltage node, and a second terminal coupled to the ground;

a third resistor, having a first terminal coupled to the voltage source, and a second terminal coupled to a second division voltage node;

a fourth resistor, having a first terminal coupled to the second division voltage node, and a second terminal coupled to the ground;

a fifth resistor, having a first terminal coupled to the voltage source, and a second terminal coupled to a third division voltage node; and a sixth resistor, having a first terminal coupled to the third division voltage node, and a second terminal coupled to the fifth pin.

7. The detection circuit as claimed in claim 6, further comprising a fifth pin coupled to the third division voltage node and configured to connect one of the first to fourth pins when the plug is accommodated in a socket, wherein the processing unit determines whether the plug is accommodated in the socket or has been removed from the socket according to toggling of the third division voltage node.

8. The detection circuit as claimed in claim 7, wherein when the plug is accommodated in the socket, a voltage on the third division voltage node is at low voltage level, and the voltage on the third division voltage node is at high voltage level when the plug has been removed from the socket.

9. The detection circuit as claimed in claim 3, wherein the microphone switch disconnects the electrical connection between the microphone output node and the first and second pins, and the microphone switch does not connect the first pin and the second pin to the ground when the plug is not accommodated in the socket.

* * * * *